US011344119B2

(12) United States Patent
Allen

(10) Patent No.: US 11,344,119 B2
(45) Date of Patent: May 31, 2022

(54) VENTILATED LOCKER WITH EQUIPMENT RACK

(71) Applicant: Sam Allen, Maypearl, TX (US)

(72) Inventor: Sam Allen, Maypearl, TX (US)

( * ) Notice: Subject to any disclaimer, the term of this patent is extended or adjusted under 35 U.S.C. 154(b) by 471 days.

(21) Appl. No.: 16/546,977

(22) Filed: Aug. 21, 2019

(65) Prior Publication Data

US 2019/0374838 A1 Dec. 12, 2019

Related U.S. Application Data

(63) Continuation-in-part of application No. 15/897,875, filed on Feb. 15, 2018, now Pat. No. 10,690,361, (Continued)

(51) Int. Cl.

| | |
|---|---|
| ***A47B 81/00*** | (2006.01) |
| ***A63B 71/00*** | (2006.01) |
| ***D06F 58/00*** | (2020.01) |
| ***D06F 58/10*** | (2006.01) |
| ***A47C 7/02*** | (2006.01) |
| ***A47C 7/40*** | (2006.01) |
| ***A47B 83/00*** | (2006.01) |
| ***A47C 1/00*** | (2006.01) |
| ***F24F 7/007*** | (2006.01) |
| ***A47F 3/00*** | (2006.01) |

(52) U.S. Cl.

CPC ..... *A47B 81/00* (2013.01); *A47B 83/00* (2013.01); *A47C 1/00* (2013.01); *A47C 7/024* (2013.01); *A47C 7/405* (2013.01); *A47C 7/407* (2013.01); *A63B 71/0036* (2013.01); *D06F 58/00* (2013.01); *D06F 58/10* (2013.01); *F24F 7/007* (2013.01); *A47F 3/001* (2013.01); *A63B 2243/007* (2013.01)

(58) Field of Classification Search

CPC . A47B 81/00; A47B 83/00; A47B 2220/0091; A47B 46/005; A47C 1/00; A47C 7/024; A47C 7/405; A47C 7/407; A63B 71/0036; A63B 2243/007; D06F 58/00; D06F 58/10; D06F 59/00; A47F 3/001; F24F 7/007

See application file for complete search history.

(56) References Cited

U.S. PATENT DOCUMENTS 2,429,050 A * 10/1947 Decker ..... B61D 33/00 312/235.7
2,759,529 A * 8/1956 Hagadorn ..... A47C 7/64 297/188.07

(Continued)

OTHER PUBLICATIONS

Clemson Football Operations Facility—Construction Documents—Mar. 15, 2016 (160316 Clemson FOF 100% CD Complete.pdf—p. 290).

(Continued)

*Primary Examiner* — Jessica Yuen
(74) *Attorney, Agent, or Firm* — James E. Walton

(57) ABSTRACT

A locker includes a pair of spaced-apart upstanding sidewalls and at least one shelf extending between the sidewalls, the shelf and sidewalls defining a compartment. A tray is carried on the shelf in the compartment and supported by a pair of rollers and coupled to a pair of rails mounted on the sidewalls above the shelf, wherein the tray slides forward and backward relative to the shelf and rotates about the rollers.

18 Claims, 14 Drawing Sheets

Related U.S. Application Data which is a continuation-in-part of application No. 15/832,073, filed on Dec. 5, 2017, now Pat. No. 10,612,846, application No. 16/546,977, which is a continuation-in-part of application No. 15/804,286, filed on Nov. 6, 2017, now Pat. No. 10,935,316.

(56) References Cited

U.S. PATENT DOCUMENTS

| | | | | |
|---|---|---|---|---|
| 3,475,769 | A * | 11/1969 | Fasanella | A47C 17/58 5/2.1 |
| 4,471,537 | A * | 9/1984 | Meda | F26B 23/005 34/77 |
| 5,369,892 | A | 12/1994 | Dhaemers | |
| 5,547,270 | A * | 8/1996 | Dang | A47B 85/08 312/194 |
| 5,628,551 | A * | 5/1997 | Block | A47B 81/00 297/126 |
| 6,860,032 | B2 * | 3/2005 | Meyer | D06F 58/10 34/225 |
| 8,365,950 | B2 * | 2/2013 | Yuyama | G07F 17/0092 221/123 |
| 2005/0204579 | A1 | 9/2005 | Rosseau et al. | |
| 2006/0112828 | A1 | 6/2006 | Ehlers | |
| 2011/0025181 | A1 | 2/2011 | Vinke et al. | |
| 2012/0193312 | A1 * | 8/2012 | Sjolander | A47F 1/12 211/59.2 |
| 2016/0258108 | A1 * | 9/2016 | Jindra | D06F 60/00 |
| 2017/0244262 | A1 * | 8/2017 | Schadow | H02J 7/0044 |
| 2017/0290726 | A1 | 10/2017 | Hovenden | |

OTHER PUBLICATIONS

Office Action dated Oct. 17, 2019 in related U.S. Appl. No. 15/804,286.
Response to Office Action dated Oct. 31, 2019 in related U.S. Appl. No. 15/804,286.
Office Action dated Dec. 11, 2019 in related U.S. Appl. No. 15/804,286.
Response to Office Action dated Jan. 13, 2020 in related U.S. Appl. No. 15/804,286.
Office Action dated Mar. 10, 2020 in related U.S. Appl. No. 15/804,286.
Response to Office Action dated Mar. 23, 2020 in related U.S. Appl. No. 15/804,286.
Office Action dated May 1, 2020 in related U.S. Appl. No. 15/804,286.
Preliminary Amendment dated Sep. 18, 2019 in related U.S. Appl. No. 16/546,977.
Office Action dated Oct. 24, 2019 in related U.S. Appl. No. 15/832,073.
Response to Office Action dated Dec. 23, 2019 in related U.S. Appl. No. 15/832,073.
Notice of Allowance dated Jan. 15, 2020 in related U.S. Appl. No. 15/832,073.
Issue Notification dated Mar. 18, 2020 in related U.S. Appl. No. 15/832,073.
Office Action dated Dec. 20, 2019 in related U.S. Appl. No. 15/897,895.
Response to Office Action dated Jan. 16, 2020 in related U.S. Appl. No. 15/897,875.
Notice of Allowance dated Apr. 23, 2020 in related U.S. Appl. No. 15/897,875.
Office Action dated Apr. 5, 2019 in related U.S. Appl. No. 15/804,286.
Office Action dated Jun. 10, 2019 in related U.S. Appl. No. 15/832,073.
Response to Office Action dated Jun. 25, 2019 in related U.S. Appl. No. 15/804,286.
Response to Office Action dated Jul. 17, 2019 in related U.S. Appl. No. 15/832,073.
SchoolLockers.com. Football Equipment Lockers, Feb. 28, 2015, SchoolLockers.com, p. 2 (Year: 2015).
Response to Office Action dated Jun. 10, 2019 in related U.S. Appl. No. 15/832,073.
Preliminary Amendment dated May 23, 2019 in related U.S. Appl. No. 15/897,875.

* cited by examiner

VENTILATED LOCKER WITH EQUIPMENT RACK

CROSS-REFERENCE TO RELATED APPLICATIONS

This application is a continuation-in-part of application Ser. No. 15/804,286, filed Nov. 6, 2017, titled "Locker with Equipment Rack;" it is also a continuation-in-part of application Ser. No. 15/897,875, filed Feb. 15, 2018, titled "Ventilated Locker," which is a continuation-in-part of application Ser. No. 15/823,073, filed Dec. 5, 2017, titled "Ventilated Locker;" all of which are hereby incorporated by reference in their entirety for all purposes.

BACKGROUND

1. Field of the Invention

The present invention relates generally to improvements in lockers or storage cabinets used in athletic or sporting facilities, and more specifically to compartments within such lockers configured and adapted especially for storing equipment such as pads or helmets.

2. Description of Related Art

The aesthetics and utility of lockers or storage cabinets in "locker rooms" of athletic and sporting facilities of sports teams and country clubs, for example, have become a measure of the quality and prestige of such organizations and an increasingly important aspect of recruiting new team or club members. Modern lockers are a far cry from the simple wood or metal cabinets of the past.

Modern lockers may incorporate storage for specific items of equipment, such as helmets and shoes, and features promoting comfort and luxury. One consistent problem in locker rooms of all types is the storage of heavy, cumbersome equipment such as football, lacrosse, or hockey helmets and pads. There is a constant need for improvement in this and other aspects of such lockers.

BRIEF DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
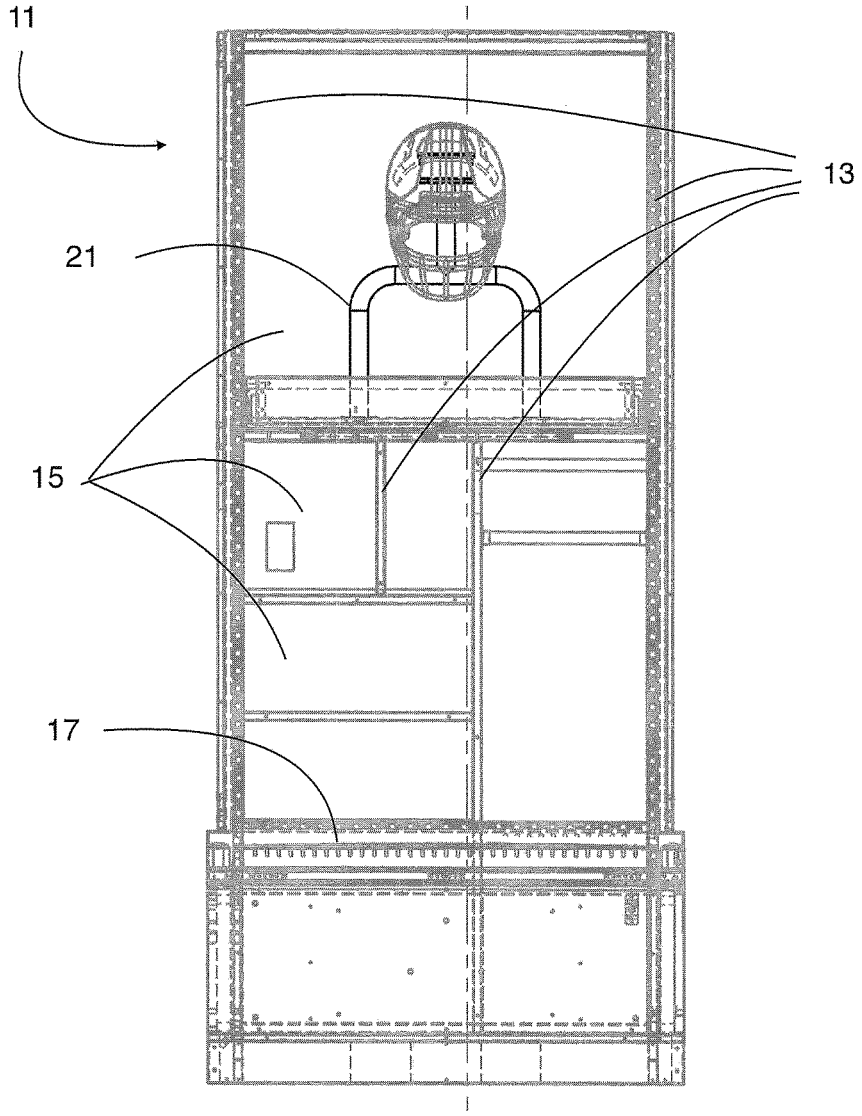
FIG. 1 is a front elevation view, partially in section, of a locker incorporating the equipment storage fixture or rack according to the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the locker according to the present application are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
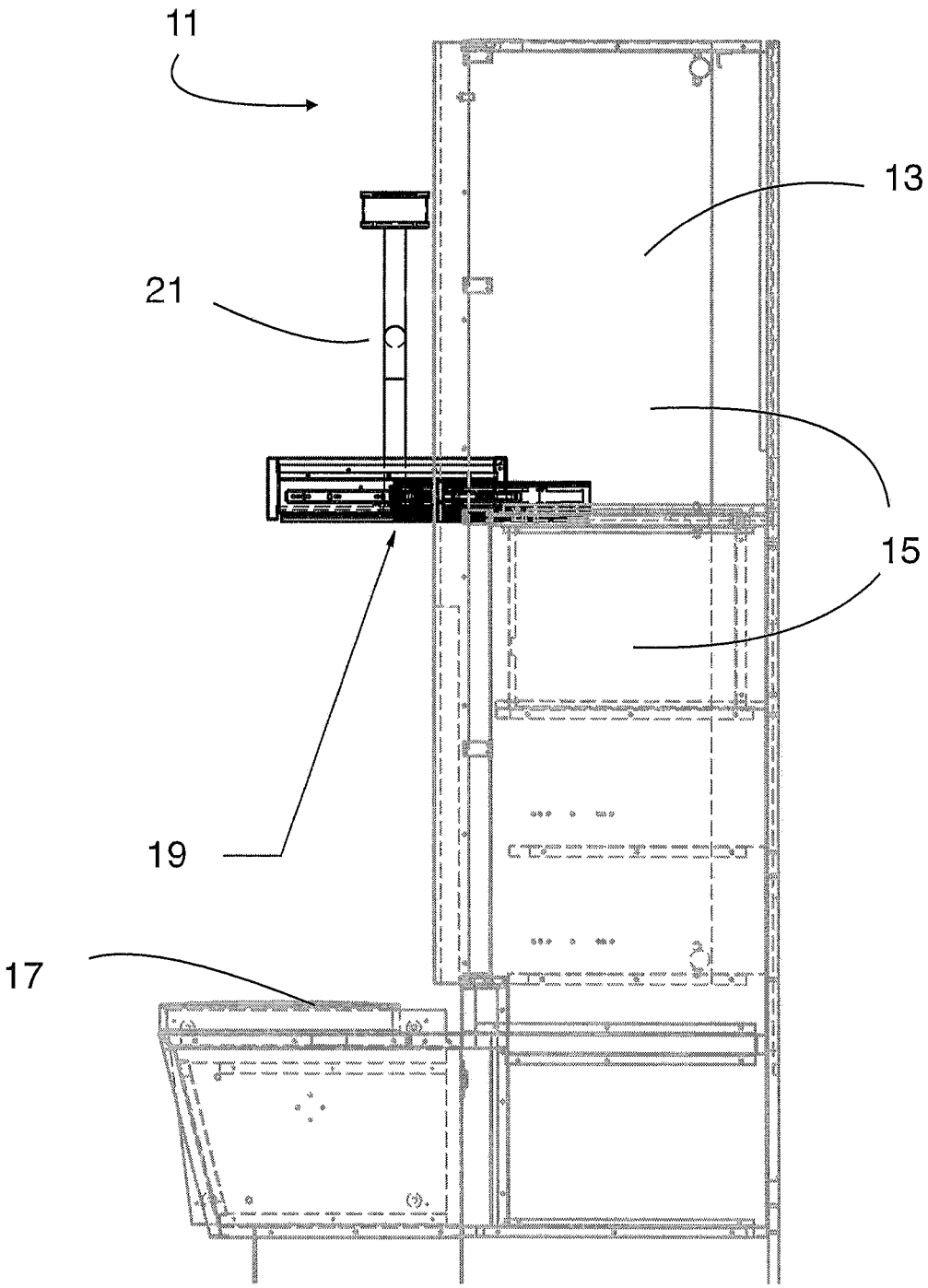
FIG. 2 is a side elevation view, partially in section of the locker of FIG. 1.

Referring now to FIGS. 1 and 2 in the drawings, a locker 11 according to an embodiment of the present application is depicted. Locker 11 comprises a pair of upstanding sidewalls 13 that generally define the extent of the locker. Each locker 11 may be installed adjacent to another, similar or identical locker, with its rear against a wall, and its front facing the interior of the locker room.

Between the sidewalls 13 of locker 11, a plurality of compartments 15 are defined by shelves or other horizontally extending surfaces or platforms. As used herein, "sidewall" or "sidewalls" may refer to either "main" sidewalls 13 or other upstanding or generally vertical sidewalls arranged between the "main" sidewalls. Multiple additional sidewalls 13 may be placed between the "main" or exterior sidewalls 13 to define compartments 15 in cooperation with generally horizontally extending shelves. These additional sidewalls and shelves may be referred to as "dividers" or "divider walls." Each compartment 15 may be sized and otherwise configured for storage of clothing or sporting equipment or other items and may include at least one door, which may be lockable. Locker 11 may also be provided with a bench seat 17 or similar seating arrangement that sits atop a "footlocker" or lowermost compartment of locker 11, which extends forward of the remainder of locker 11, and may be divided into multiple compartments.

Among the compartments in locker 11 according to the present application may be a helmet or pad compartment, generally located at the upper end of locker 11. An equipment fixture or rack 21 may be disposed on the shelf defining the lower extent of the helmet or pad compartment. Rack 21 may be configured and arranged to store a football or similar helmet alone or together with shoulder pads or other protective equipment. The shelf on which rack 21 is mounted may preferably be provided with drawer slides to permit the shelf and rack 21 to move horizontally in and out of the compartment of locker 11 between an extended or deployed position and a stored position for ease of use, as shown in FIG. 2 (see also FIG. 5, below). The shelf may also be provided with a tilting feature to permit downward tilting of the shelf when pulled forward or out of the compartment, again for ease of placing and removing equipment on rack 21. Rack 21 may be mounted directly to a shelf, with or without sliding or tilting features, or to a separate platform or other member carried by the shelf or sidewall 13.

Figure 3A:
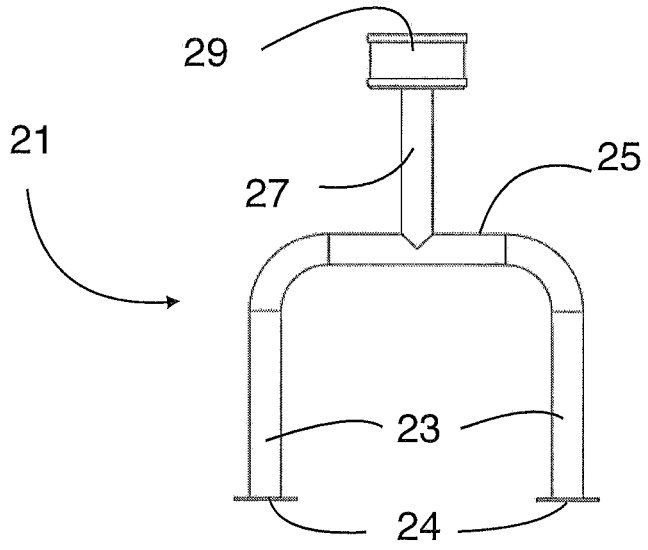
FIGS. 3A and 3B are elevation and perspective views of the equipment storage fixture or rack shown in FIGS. 1 and 2.
Figure 3B:
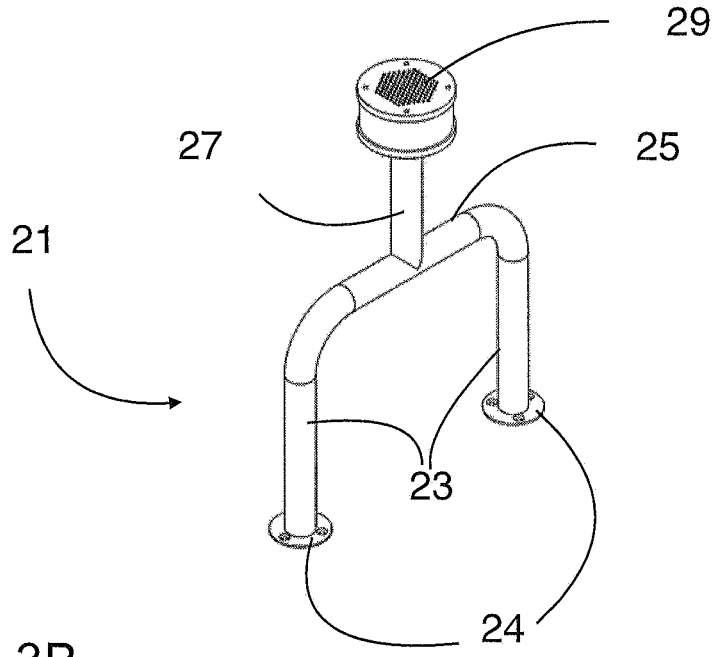

As shown in FIGS. 3A and 3B, rack 21 may comprise a pair of upstanding, spaced-apart posts 23, which are secured to the shelf or platform by flanges 24. Posts 23 may be connected at their upper ends by a cross-member or crossbar 25. The distance or dimension between posts 25 may be narrower than a pair of shoulder pads and the height of crossbar 25 may be sufficient to support the pads above the shelf so that the pads contact only rack 21. A helmet post 27 may extend upwardly from approximately the center or middle of crossbar 25 and may terminate in a helmet support member 29, which contacts and supports the interior of a helmet. Helmet post 27 may be dimensioned so that a helmet is suspended entirely above crossbar 25 (as shown in FIG. 1). Helmet support member 29 may incorporate a ventilator or helmet ventilation system. The ventilator may be an electric fan contained in a perforated housing that is operably associated with support member 29, preferably a model QFR0812SH-F00 from Delta Products Corp., 46101 Fremont Blvd, Fremont, Calif. 94538, U.S.A. The fan may circulate air in, around, and through a helmet or other equipment stored on post 27 for drying and deodorization purposes. Alternatively, the ventilator may be coupled to a "forced air" ventilation or air circulation system that is part of locker 11 or a system of lockers or a room HVAC system, as described below in connection with FIGS. 6A through 7C.

The fan may be powered by AC or DC electric current and may be provided with a switch to control its operation. The switch may be actuated by the weight of the helmet on post 27 and support member 29, manually, by a timer, by voice actuation, by detection of the presence of a condition such as heat, moisture, or odor, or the like.

Rack or fixture 21 may be constructed of steel or aluminum tubing, welded or otherwise secured together in sections comprising posts 23, crossbar 25, and post 27 and secured to its shelf by screws or bolts through a flange, as illustrated. The hollow nature of the preferred tubing may permit passage of electric cables and air or other gases for power or ventilation and reduces the overall weight of rack 21.

Figure 4:
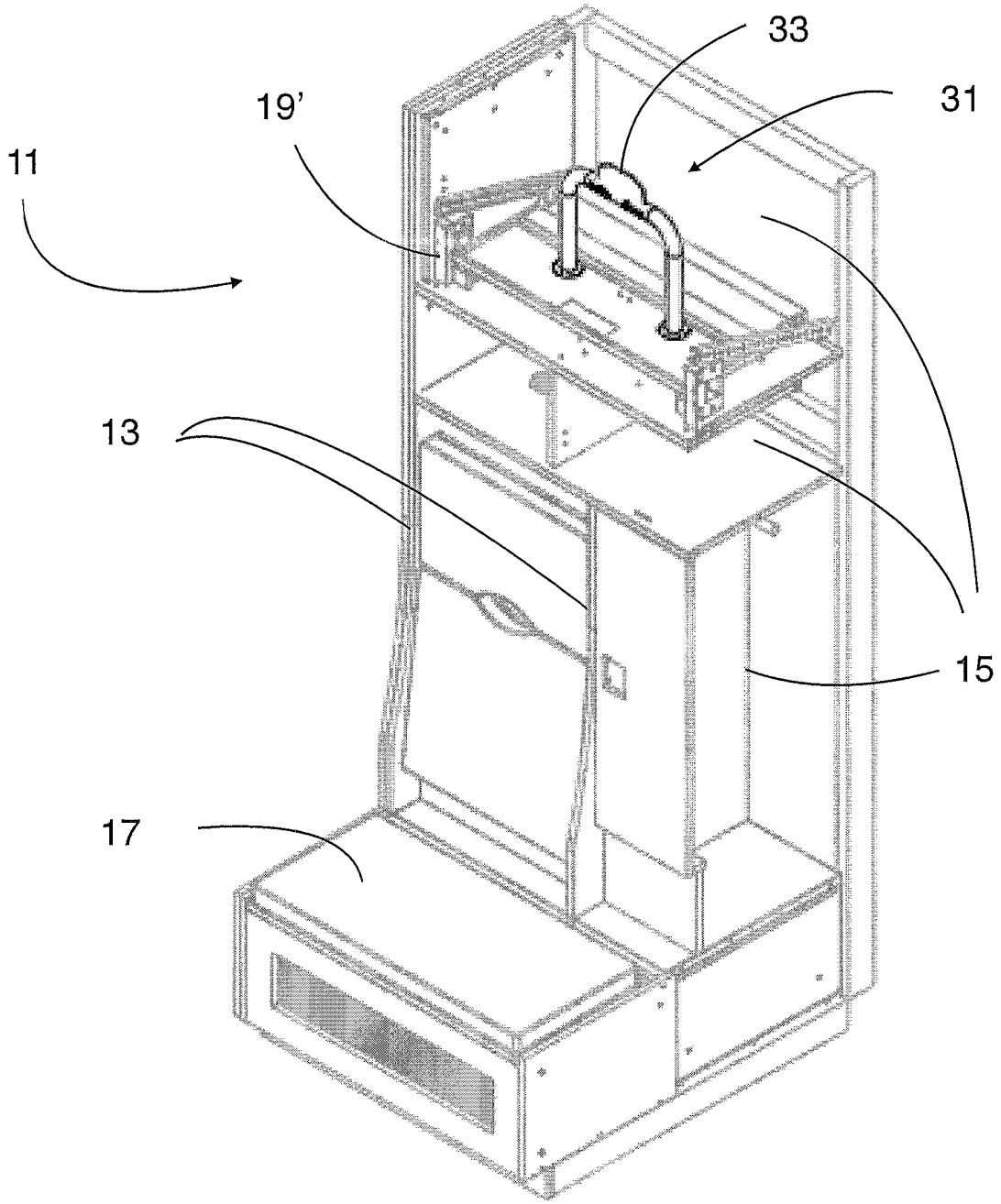
FIG. 4 is a perspective view of a locker incorporating the equipment storage fixture or rack according to a second embodiment of the present application.
Figure 5:
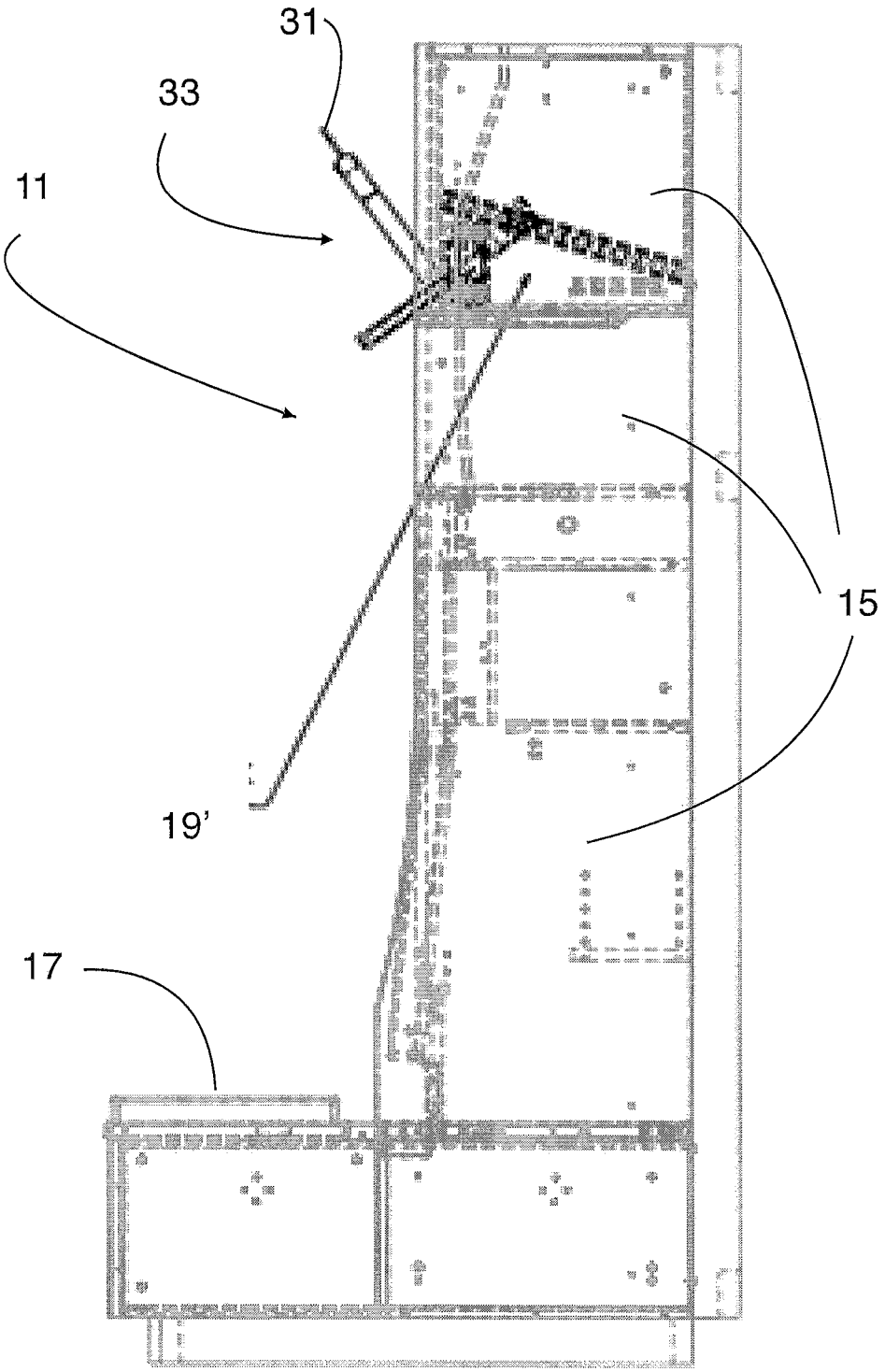
FIG. 5 is a side elevation view, partially in section, of the locker of FIG. 4.

FIGS. 4 and 5 depict a locker 11 similar to that of FIGS. 1 and 2, but incorporating a fixture or rack 31 according to another embodiment of the present application. Fixture or rack 31 is similar in form and operation to that illustrated in FIGS. 3A and 3B, except that helmet post 27 and support member 29 are omitted. This embodiment is intended for storage of pads, e.g. shoulder pads, only, and no helmet. Accordingly, a small vertical projection or tab takes the place of helmet post 27 and serves to help "center" or locate pads on rack 31. Further, as shown in FIG. 5, rack 31 may be mounted on a shelf with a tilting feature 19' that permits forward tilting of shelf and rack 31, with or without sliding the shelf forward or out of the storage compartment so that the shelf and rack 31 are movable between an extended or deployed position and a storage position. Again, rack 31 may be mounted directly to a shelf or to a platform coupled to or carried by the shelf or sidewall 13 of locker 11.

Referring now to FIGS. 6A through 6D and 7A through 7C in the drawings, two embodiments of lockers 111, 211 according to the present application are depicted. Locker 111, 211 generally comprises a pair of upstanding sidewalls 113, 213 that generally define the extent of the locker. A back wall 115, 215 connects sidewalls 113, 213 at the rear of each locker 111, 211. Each locker 111, 211 may be installed adjacent to another, similar or identical locker, with its rear against a wall, and its front facing the interior of the locker room.

Between the sidewalls 113, 213 of locker 111, 211, a plurality of compartments 117, 217 are defined by shelves or other horizontally extending surfaces or platforms. As used herein, "sidewall" or "sidewalls" may refer to either "main" sidewalls 113, 213 or other upstanding or generally vertical sidewalls arranged between the "main" sidewalls. Multiple additional sidewalls 113, 213 may be placed between the "main" or exterior sidewalls 113, 213 to define compartments 117, 217 in cooperation with generally horizontally extending shelves or platforms. These vertical and horizontal walls may also be referred to as "dividers" or "divider walls" because they further divide compartments. Each compartment 117, 217 may be sized and otherwise configured for storage of clothing or sporting equipment or other items and may include at least one door, which may be lockable. Locker 111, 211 may also be provided with a bench seat 119, 219 or similar seating arrangement.

A plenum 131, 231 may be mounted on the rear or exterior side of back wall 115, 215. Plenum 131, 231 may be connected via duct work (not shown) to the existing HVAC of the locker room or room in which locker 111, 211 is disposed or situated, Plenum 131, 231, may be generally coextensive with back wall 115, 215 or may be smaller or larger. The HVAC system to which plenum 131, 133 is connected may be the conventional heating and cooling system of the building or room in which locker 111, 211 is disposed, or may be a dedicated system for the lockers themselves. Plenum 131, 231 may be connected to HVAC system at its upper end or extent, or to either or both sides, or at the bottom. The HVAC system thus provides (positive pressure) or removes (negative pressure) heated, cooled, and/or dehumidified air to each locker 111, 211, through plenum 131, 231. Plenum may deliver or remove air from locker 111.

Plenum 131, 231 may communicate air from the HVAC system to the interior and various compartments 117, 217 of locker 111, 211, through a plurality of ventilation apertures or grilles 133, 233 formed in back wall 115, 215 of locker 111, 211. Preferably, a grille or aperture 133, 233 (grille is used herein to mean a single aperture or a group of apertures in any arrangement, e.g. circles, squares, other shapes, arranged in any pattern) is arranged through back wall 115, 215 at least an upper extent and a lower extent (near the top and near the bottom) of locker 111, 211 to insure a supply of air to the entirety of the locker or at least the upper and lower compartments thereof.

Grilles 133, 233 may preferably be provided with a damper arrangement or mechanism that permits the partial closure or obstruction of the aperture(s) of grilles 133, 233 to control the flow of air from plenum 131, 231. One or more front or forward ventilation grilles 137, 217 may be provided in the front panels or dividers (forward of back wall 115, 215 and generally between side walls 113, 213) of locker 111, 211 to permit exhaust or intake of air from or to the locker. Alternatively, the natural gaps left between doors and openings in locker 111, 211 can provide the exhaust or intake of air. Grilles 133, 233 and their dampers may be controlled (opened or closed, fully or partially) manually or automatically, as by a programmed computer. Automatically controlled grilles may operate on a "schedule" (e.g. open or closed at night or during daylight hours) or according to airflow or other parameters, such as relative humidity in the locker room and the like.

Figure 7A:
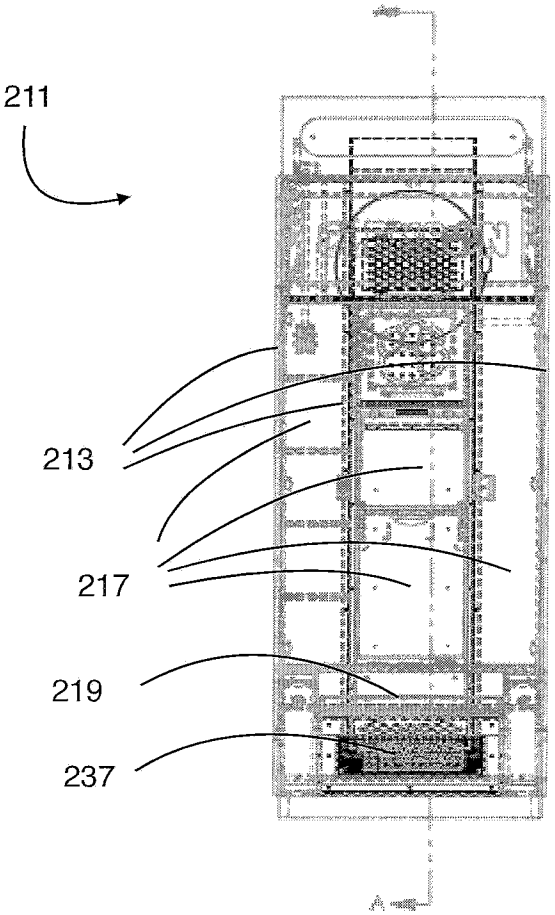
FIGS. 7A through 7C are front, back, and side elevation views, partially in section, of a locker incorporating the equipment storage fixture or rack according to another embodiment of the present application.
Figure 6A:
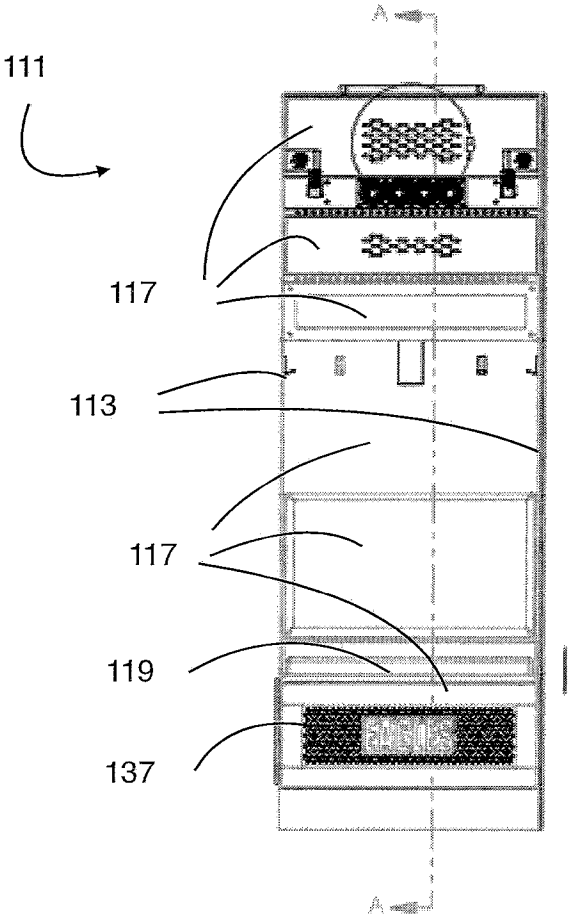
FIGS. 6A through 6D are front, back, and side elevation views, and a perspective view, partially in section, of a locker incorporating the equipment drying fixture or rack according to the present application.
Figure 7B:
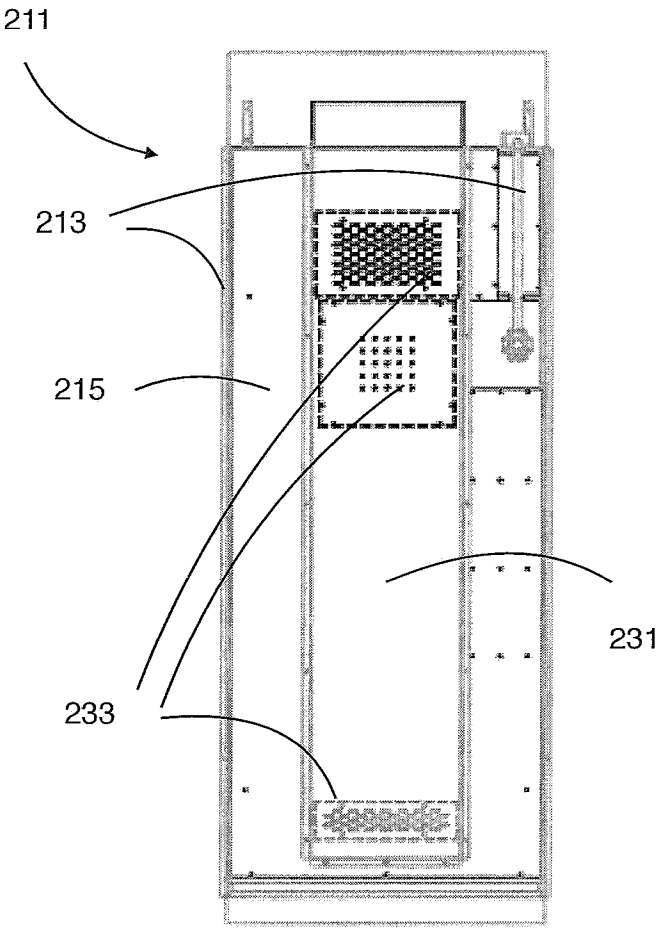
Figure 6B:
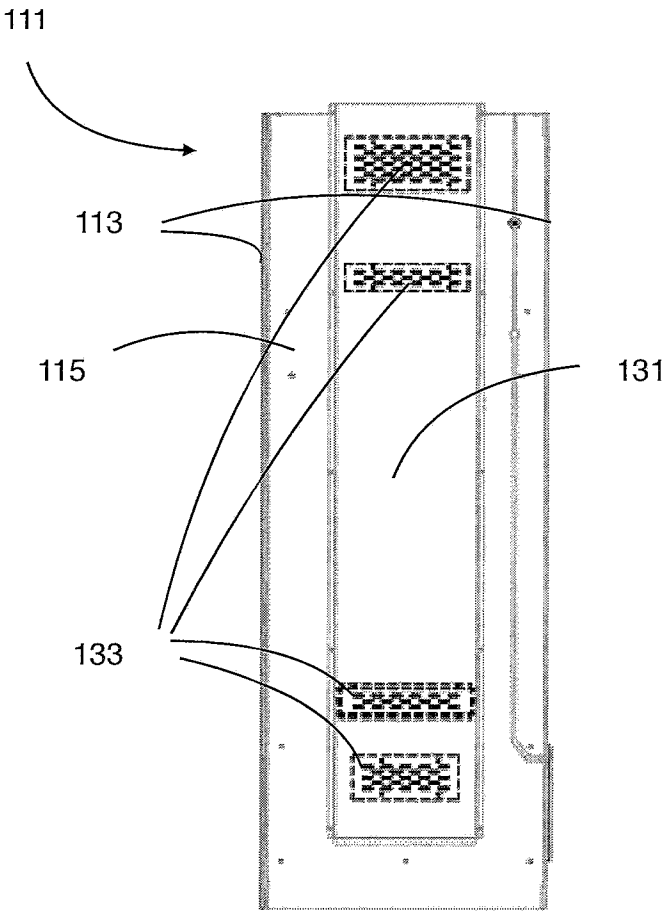
Figure 7C:
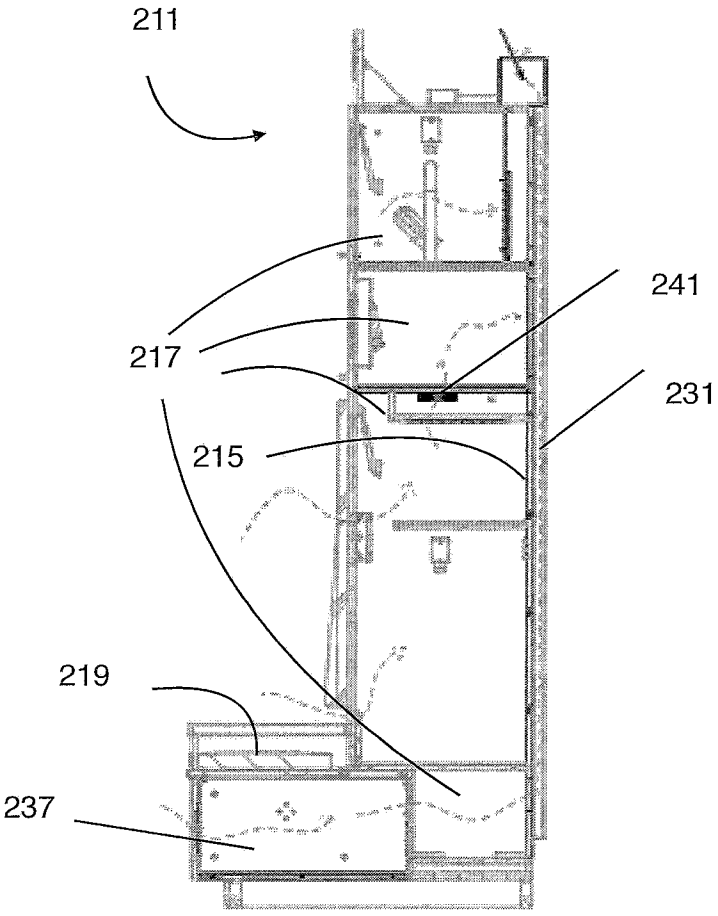
Figure 6C:
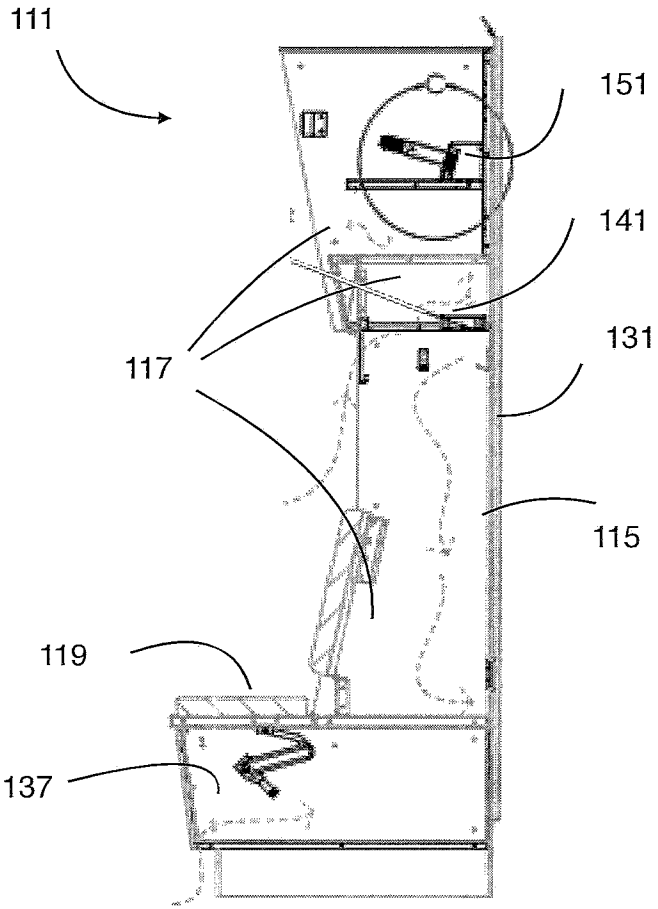

Thus, airflow may be established (either vacuum/suction or positive pressure) through locker 111, 211 from plenum 131, 231, through ventilation grille 133, 233, and exits (or enters in the case of suction) locker 111, 211 through ventilation grille 137, 237 or other openings in the front or forward portions of locker. Alternatively, air circulated through the locker may be exhausted through a duct or conduit to an area remote from lockers 111, 211 and/or the locker room or building in which they are located. This circulation may be assisted by one or more circulation fans 141, 241. Circulation fan 141, 241 may be mounted to the upper or lower surface of a shelf, as illustrated, and the shelf may be provided with flow apertures so that fan 141, 241 can circulate air between the compartments separated by a shelf or divider to insure circulation through the entirety of locker 111, 211. In the embodiment of FIGS. 7A through 7C, for example, fan 241 is mounted under a shelf that forms a helmet storage compartment. Vent holes or apertures in the shelf permit circulation of air from fan 241 up into the helmet resting on the shelf, and may be provided with a ventilation grille, as previously described. A preferred fan 141, 241 is an Arctic F12 Silent 120 mm fan available from ARCTIC GmbH, Fasanenkamp 12, 38108 Braunschweig, Germany.

Figure 8:
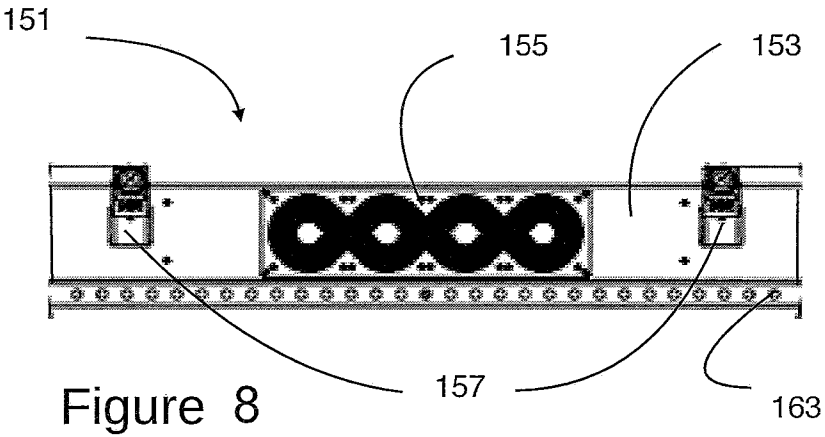
FIGS. 8 and 9 are enlarged front and side views of an equipment drying fixture illustrated in the embodiment of FIGS. 6A through 6D.
Figure 9:
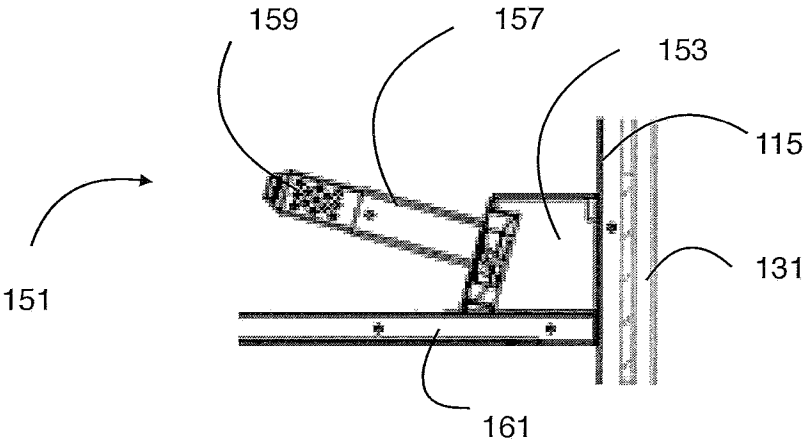
Figure 6D:
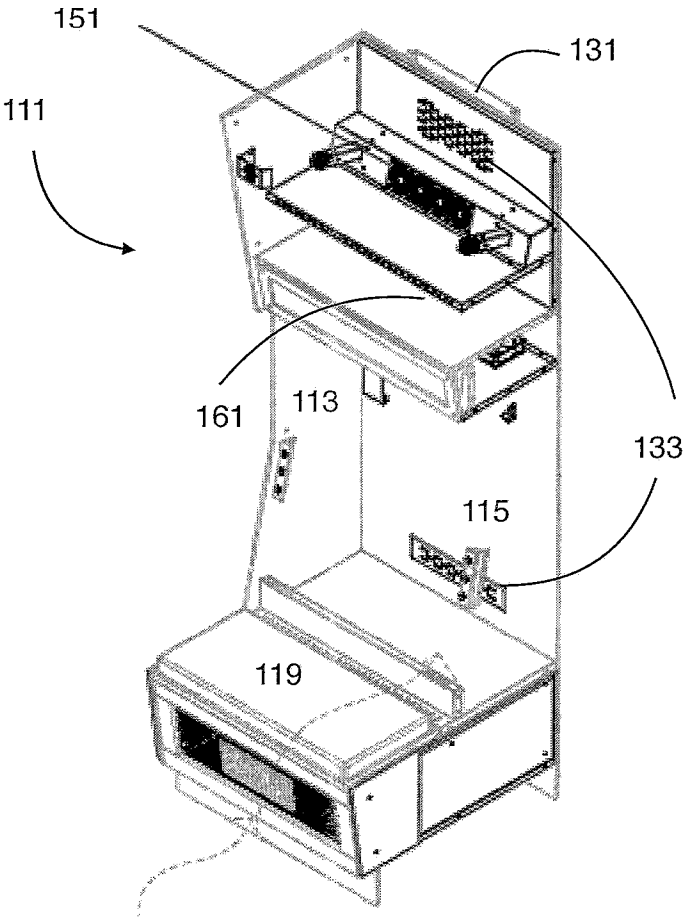

In addition, or as an alternative, to circulation fans 141, 241, equipment-drying fixtures, such as glove and equipment dryer 151, may be provided in one or more compartments. As shown in detail FIGS. 8 and 9, fixture 151 comprises a generally rectangular manifold or plenum 153, that sits at the rear of a shelf 161 adjacent back wall 115 of locker 111. At least one and preferably four fans 155 may be carried by manifold 153 at approximately the midpoint thereof to provide intense air circulation in the central portion of the compartment. A pair of hollow, tubular projections 157 are outboard of fans 155 on either side and in fluid communication with manifold 153. Another fan 159 is carried in a perforated housing at the distal end of each projection 157 to increase air circulation at the distal end of each projection 157. Projections 157 are adapted to be received in the interior of and to support relatively small equipment such as gloves, or even shoes or socks, for drying thereof.

Manifold 153 may be connected to plenum 131 through flow apertures in back wall 115 and thus draws air from the HVAC system. It also draws "ambient" air through shelf 161, which is hollow and features intake apertures 163 at its front edge. Fans 155 may preferably be model QFR0812SH-F00 from Delta Products Corporation, 46101 Fremont Blvd, Fremont, Calif. 94538. Fans 159 may preferably be ASB0412VHA-AF00, also from Delta Products Corporation.

Figures 10A, 10B:
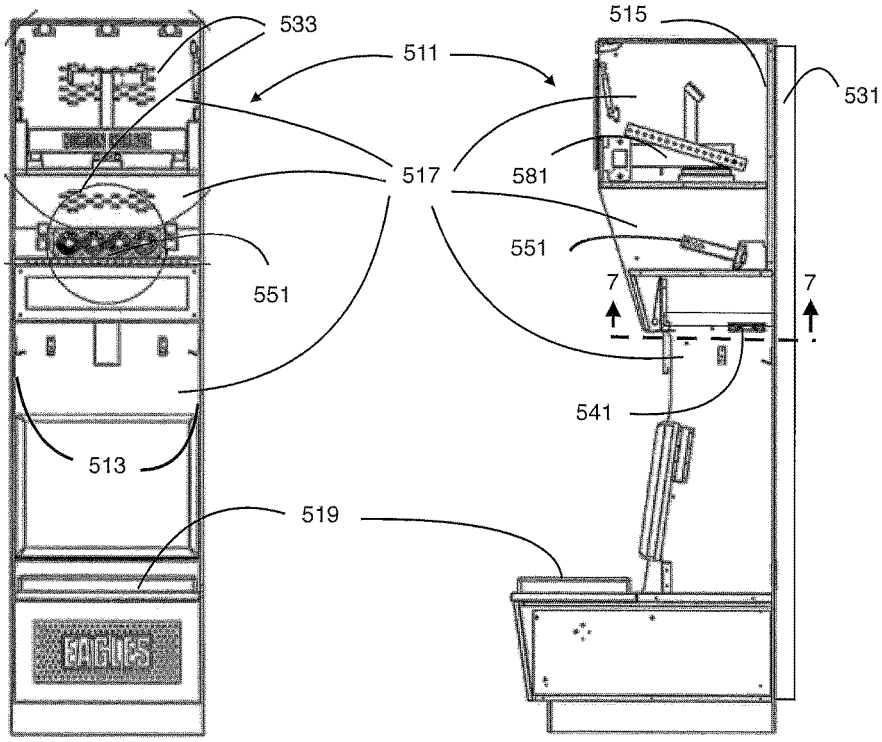
FIGS. 10A and 10B are front and side elevation views of another embodiment of a locker according to the present application.

FIGS. 10A and 10B are elevation and side views of a locker 511 similar in many respects to those described above, but further adapted for storage of extremely wet equipment for sports such as hockey. One aspect of locker 511 is that it is constructed entirely of solid phenolic core panel material (available from Wilsonart LLC 2501 Wilsonart Drive, P.O. Box 6110 Temple, Tex. 76503-6110) and stainless steel. The panel material is mostly polymeric (rather than fibrous or cellulosic, as in the case of wood and wood products) and resembles wood or wood laminates but is water-resistant and impervious to long-term exposure to moisture.

Locker 511 is generally similar to locker 111, with sidewalls 513, back wall 515, and shelves or horizontal surfaces defining compartments 517. A seat 519 may be provided. A plenum 531 may be carried on back wall 515 to connect to a pre-existing HVAC system to apply negative pressure (vacuum or suction) to the interior of locker 511 to remove or evacuate moisture-laden air. Ventilation grilles 533 may be provided in back wall 515 to draw in air from the exterior of locker 511, and may be provided with dampers or adjustable apertures, as described above.

A plurality (three) of circulation fans 541, as described above, may be secured to the lower surface of a horizontal shelf with appropriate apertures (see FIG. 7) to promote air circulation within locker 511, between upper and lower compartments. A glove or equipment dryer 551, as described above, may be disposed in a medially located compartment 517.

Figure 11:
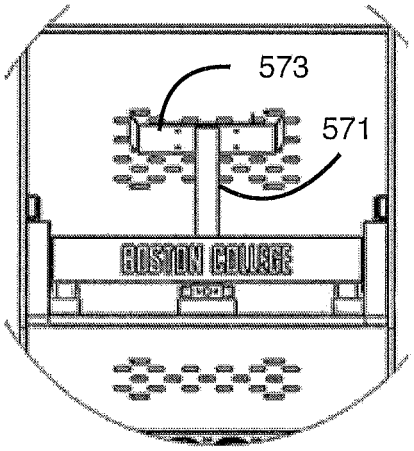
FIGS. 11 and 12 are enlarged elevation views of portions of the locker of FIGS. 10A and 10B.
Figure 12:
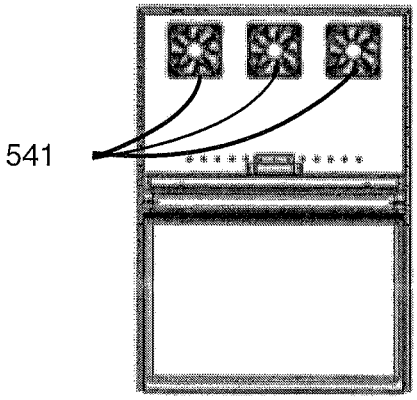
Figure 13:
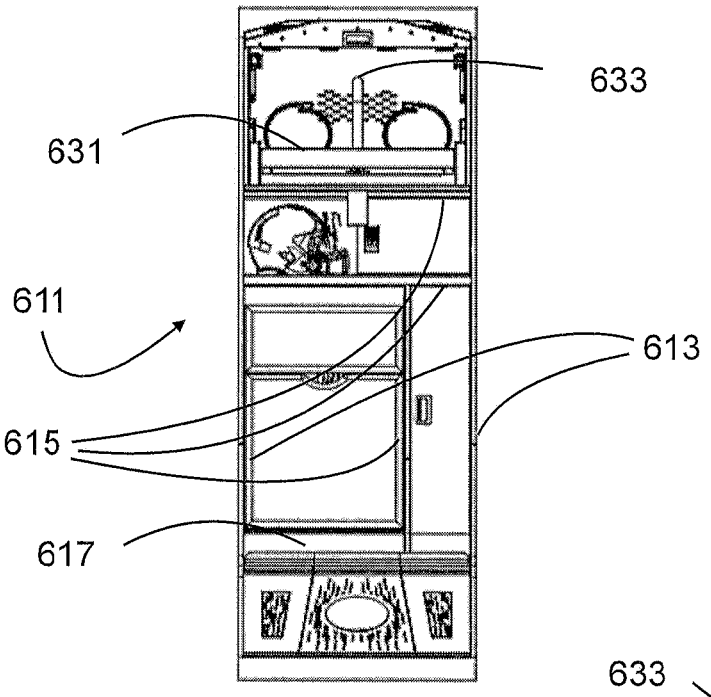
FIGS. 13 and 14 are front and side elevation views, respectively, of another embodiment of a locker according to the present application.
Figure 14:
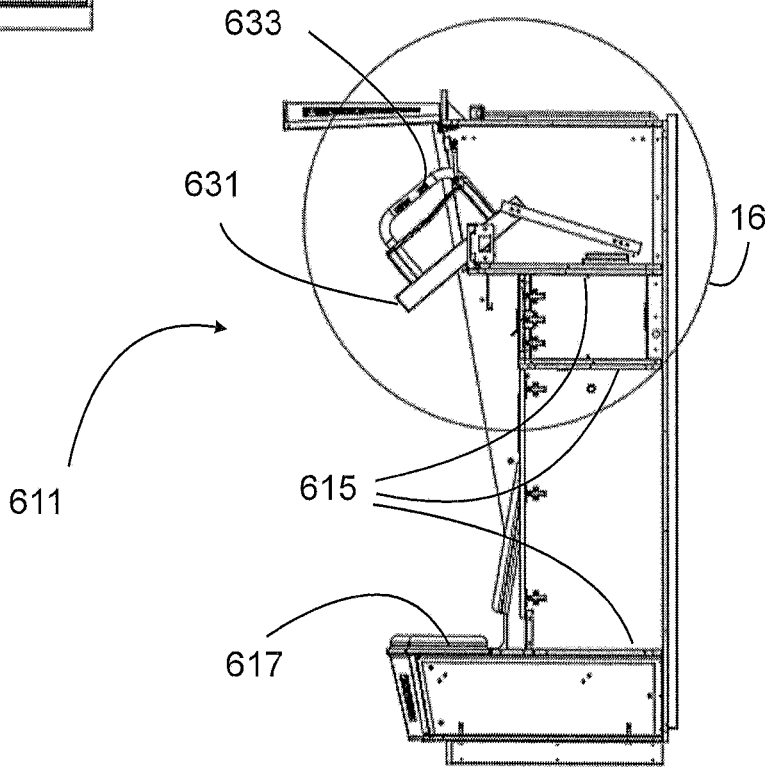

A skate rack 571, 573, may be disposed in an uppermost compartment 517 of locker 511 for storage of ice or roller skates, as shown in greater detail in FIGS. 11 and 12. Rack comprises a vertically extending member 571, with a horizontally extending member or cross bar 573 that provides a pair of horizontally extending projections on either side of vertical member 571 that may be received in the interior of a skate boot to support the skates while stored and drying. The skate rack 571, 573 may be carried on a pull-out drawer 581 that slides in and out of compartment 517 for ease of access.

Turning now to FIGS. 13 through 17, an embodiment of a locker 611 in accordance with an aspect of the present application is shown. Locker 611 is generally similar to those previously described and includes a pair of sidewalls 613 and a number of horizontal and vertical dividers or sidewalls and shelves 615, which define a number of compartments, including a lowermost "footlocker" compartment with a generally horizontal seat 617.

Figure 15:
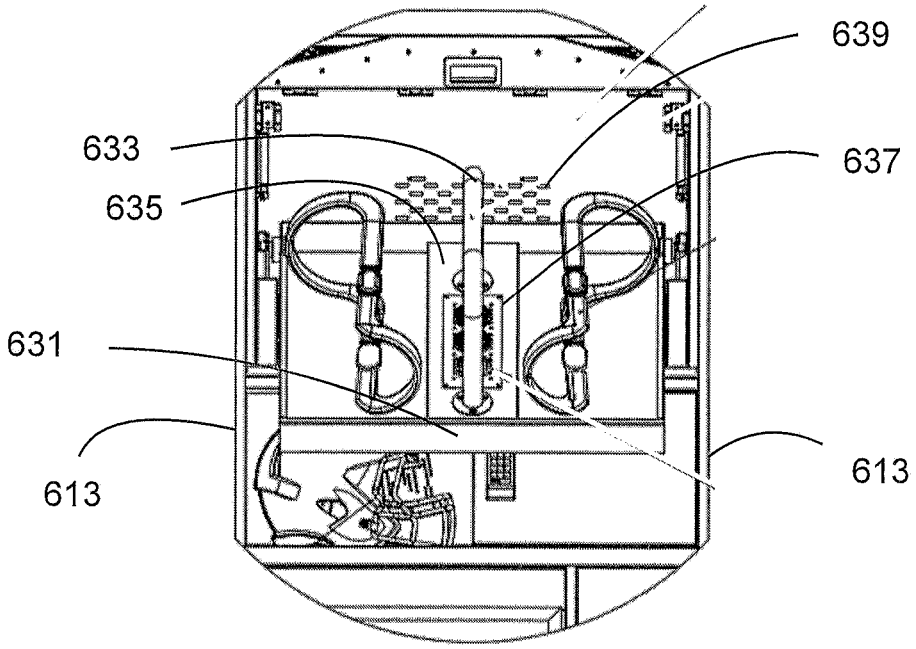
FIG. 15 is an enlarged front elevation view, partially in section, of a portion of the locker of FIGS. 13 and 14.

At an upper extent of locker 611, a horizontal shelf or divider 615 defines an uppermost equipment compartment above a helmet compartment. A tilting and sliding tray 631 may be provided in the equipment compartment immediately above shelf 615 (a pair of knee braces are shown on the tray). An inverted U-shaped tubing equipment rack 633, similar to the shoulder pad rack described above in connection with FIGS. 4 and 5 (but rotated 90 degrees), may be carried on tray 631. As illustrated in FIG. 15, rack 633 may be mounted atop a rectangular box manifold 635, which may be provided with ventilation fans 637, which moves air through shoulder pads or other equipment carried on rack 633. Fans 637 may be model QFR0812SH-F00 from Delta Products Corporation, 46101 Fremont Blvd, Fremont, Calif. 94538. A ventilation grille or apertures 639 may be provided in the back wall of the compartment to communicate with the locker ventilation system, as described above.

Figure 16:
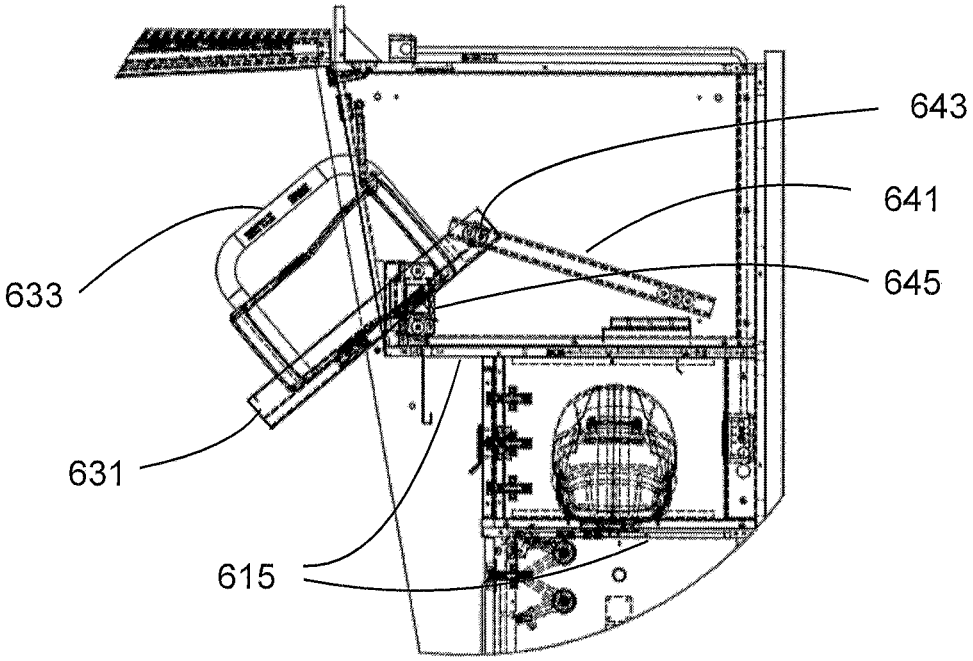
FIG. 16 is an enlarged side elevation view of a portion of the locker depicted in FIG. 13.
Figure 17:
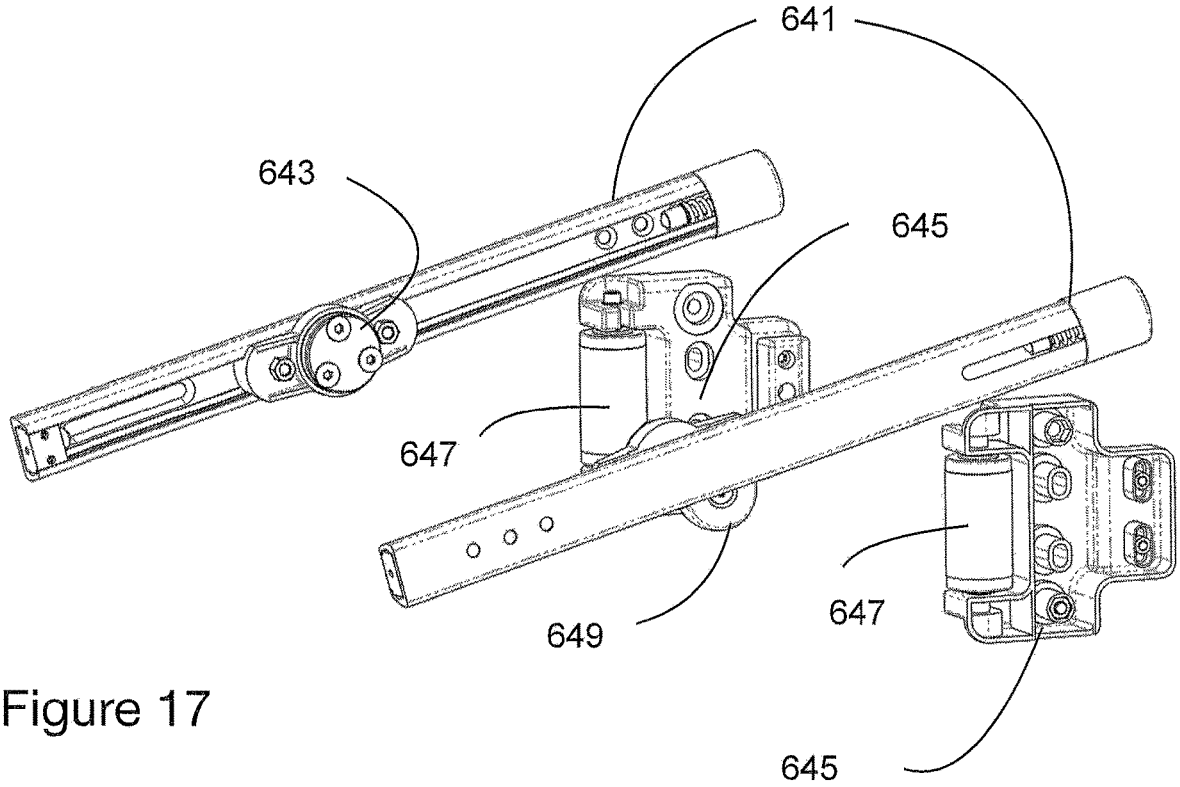
FIG. 17 is an exploded view of the rail and roller system employed in the locker of FIGS. 13 and 14.

Shelf 631 may slide forward and tilt or rotate downward to improve access to equipment stored on tray 631 and rack 633, as depicted in FIG. 16. This motion is enabled by a pair of rails 641 and a pair of roller assemblies 645, as shown in FIG. 17. Rails 641 may be mounted on the sidewalls of the equipment compartment. A sliding pivot 643 is carried by each rail 641. Pivots 643 rotate and slide relative to rail 641. Tray 631 thus may be mounted to pivots 643 and will rotate and slide relative to rail 641, permitting the shelf to move or slide fore and aft within the compartment and also rotate relative to rails 641.

A pair of roller assemblies 645 may be carried at the front of compartment at the corners or intersections of sidewalls 613 and shelf 615. Roller assemblies 645 support tray 631 as it moves forward and rearward within the compartment. Each roller assembly 645 includes both a vertical roller 647 and a horizontal roller 649 carried by a frame, which may be mounted to sidewalls 613, shelf 615, or both. Rollers 647, 649 cooperate to center tray 631 in compartment and support it as it tilts and slides. Horizontal rollers 649 become the pivot point around which shelf 631 pivots as it tilts or rotates. Rails 641 and roller assemblies 645 are available as model 4070.1000 from Sliding Systems, Gledrid Industrial Park, Chirk, Wrexham, LL14 SDG, United Kingdom.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description and claims. Although the present embodiments are shown above, they are not limited to just these embodiments, but are amenable to various changes and modifications without departing from the spirit thereof.

I claim:

1. A locker, comprising:
a pair of spaced-apart upstanding sidewalls;
at least one shelf extending between the sidewalls, the shelf and sidewalls defining a compartment;
a tray carried on the shelf in the compartment and supported by a pair of rollers and coupled to a pair of rails mounted on the sidewalls above the shelf; and
an equipment rack carried on the tray;
wherein the tray slides forward and backward relative to the shelf and rotates about the rollers; and
wherein the equipment rack is ventilated.

2. The locker of claim 1, wherein each of the pair of rollers comprises:
a horizontal roller;
a vertical roller; and
a frame supporting the horizontal and vertical rollers, the frame secured to one of the sidewall and shelf at an intersection of the sidewall and shelf.

3. The locker of claim 1, wherein each of the rails comprises:
a sliding pivot carried by the rail and secured to a portion of the tray;
wherein the tray slides and rotates relative to the rail.

4. The locker of claim 1, further comprising:
an equipment ventilation system operably associated with the equipment rack for providing airflow in and around equipment disposed on the equipment rack.

5. A locker, comprising:
a pair of spaced-apart upstanding sidewalls;
at least one shelf extending between the sidewalls, the shelf and sidewalls defining a compartment;
a rail carried on each of the sidewalls above the shelf;
a pivot carried by each rail, the pivot rotating and sliding relative to the rail;
at least one roller carried by one of the shelf and sidewall;
a tray coupled to each of the pivots and supported by the roller; and
an equipment rack carried on the tray;
wherein the tray slides and rotates relative to the sidewalls and rails; and
wherein the equipment rack is ventilated.

6. The locker of claim 5, wherein the roller comprises:
a horizontal roller;
a vertical roller; and
a frame supporting the horizontal and vertical rollers, the frame secured to one of the sidewall and shelf at an intersection of the sidewall and shelf.

7. The locker of claim 5, further comprising:
an equipment ventilation system operably associated with the equipment rack for providing airflow in and around equipment disposed on the equipment rack.

8. A locker, comprising:
a pair of spaced-apart upstanding sidewalls;
at least one shelf extending between the sidewalls, the shelf and sidewalls defining a compartment;
at least one equipment rack within the compartment;
a back wall connecting the side walls;
a plenum disposed behind to the back wall, the plenum configured for removing air from the compartment;
a seat bench; and
a pivoting seatback configured to at least partially enclose the compartment;
wherein the compartment is in fluid communication with the plenum; and
wherein the at least one equipment rack is in fluid communication with the plenum.

9. The locker of claim 8, wherein the pivoting seatback comprises:
an upper seatback member; and
a lower seatback member.

10. The locker of claim 9, wherein the upper seatback member is configured to pivot upward and the lower seatback member is configured to pivot downwards.

11. The locker of claim 8, wherein the pivoting seatback is configured to pivot away from the back wall to provide access to the compartment.

12. The locker of claim 11, wherein the pivoting seatback is configured to pivot toward the seat bench.

13. The locker of claim 8, wherein the pivoting seatback pivots down to rest upon the seat bench.

14. The locker of claim 8, wherein the plenum and the compartment are connected through at least one aperture in the back wall.

15. The locker of claim 8, wherein the seat bench comprises:
a seat cushion; and
wherein the pivoting seatback comprises:
at least one padded seat cushion.

16. The locker of claim 8, wherein the seatback is inclined.

17. The locker of claim 8, wherein the seat bench covers a second compartment.

18. The locker of claim 8, wherein the pivoting seatback is configured to allow air to flow from outside of the locker into the compartment.

* * * * *